US006315056B1

(12) United States Patent
Ransom et al.

(10) Patent No.: US 6,315,056 B1
(45) Date of Patent: Nov. 13, 2001

(54) RESILIENT SCRAPING BLADE ATTACHMENT

(76) Inventors: Desmond L. Ransom, 10150 Maple Glen, #11, Dillsboro, IN (US) 47018; Jon Thomas Thompson, 307 Fourth St., Aurora, IN (US) 47001

( * ) Notice: Subject to any disclaimer, the term of this patent is extended or adjusted under 35 U.S.C. 154(b) by 0 days.

(21) Appl. No.: 09/628,000

(22) Filed: Jul. 28, 2000

Related U.S. Application Data

(60) Provisional application No. 60/146,528, filed on Jul. 30, 1999.

(51) Int. Cl.[7] ..... A01B 15/00

(52) U.S. Cl. ..... 172/684.5; 172/817; 172/246; 172/253; 172/612; 37/233; 37/266; 37/407; 37/903

(58) Field of Search ..... 172/810, 811, 172/815, 817, 818, 819, 820, 827, 245, 246, 247, 253, 612, 684.5, 685, 747; 37/232, 233, 241, 266, 268, 403, 407, 903

(56) References Cited

U.S. PATENT DOCUMENTS

| | | | |
|---|---|---|---|
| D. 278,099 | | 3/1985 | Evans . |
| 1,828,715 | | 10/1931 | Oishei . |
| 2,061,585 | * | 11/1936 | Meyer . |
| 2,642,294 | | 6/1953 | Holm . |
| 2,689,369 | | 9/1954 | Biek . |
| 2,914,787 | | 12/1959 | Hartkopf . |
| 3,008,251 | | 11/1961 | Cline et al. . |
| 3,413,738 | | 12/1968 | Goldberg . |
| 3,465,456 | * | 9/1969 | Meyer . |
| 3,477,149 | | 11/1969 | Wagner . |
| 3,545,109 | * | 12/1970 | Boschung . |
| 3,866,342 | * | 2/1975 | Cooper . |
| 4,037,289 | | 7/1977 | Dojan . |
| 4,307,523 | | 12/1981 | Reissinger et al. . |
| 4,463,507 | * | 8/1984 | Gaub . |
| 4,597,205 | * | 7/1986 | Guest . |
| 4,651,451 | * | 3/1987 | Beeley et al. . |
| 4,819,349 | | 4/1989 | Mensch . |
| 4,936,392 | * | 6/1990 | Kitchin . |
| 5,075,985 | | 12/1991 | Mensch . |
| 5,136,795 | * | 8/1992 | Rosenberg . |
| 5,377,766 | * | 1/1995 | Klinger . |
| 5,471,770 | | 12/1995 | Ferreira . |
| 5,497,569 | | 3/1996 | Byman . |
| 5,528,793 | * | 6/1996 | Schbot . |
| 5,611,157 | * | 3/1997 | Ferreira . |
| 5,638,617 | * | 6/1997 | Belanger et al. . |
| 5,724,755 | * | 3/1998 | Weagley . |
| 5,819,443 | | 10/1998 | Winter . |
| 6,070,343 | * | 6/2000 | Sheldon . |

OTHER PUBLICATIONS

Product brochure by Mensch Mfg., Hastings, MI.

* cited by examiner

*Primary Examiner*—Victor Batson
(74) *Attorney, Agent, or Firm*—Frost Brown Todd

(57) ABSTRACT

The resilient scraping blade attachment is provided that includes an attachment hook-up assembly adapted to be mounted on a vehicle. The attachment hook-up assembly includes an elongated central support member and a vehicle interface component. In addition, the attachment hook-up assembly includes a pair of diagonal supports that link the central support member to the vehicle interface component. A mounting plate is secured at an end of the central support member. A resilient blade assembly is attached to the attachment hook-up assembly by means of a bearing bracket and bearing means. The resilient blade assembly includes an elongated blade mounting channel having a pair of resilient blades mounted thereon. The resilient blade assembly includes extension blades that may be mounted at the ends of the blade mounting channel in order to increase the effective width of the resilient blade assembly. The extension blades may be contoured to approximate different surfaces such as a roadside curb. A hydraulic cylinder is mounted on the attachment hook-up assembly and includes a piston that is mounted on the resilient blade assembly to control and pivot the resilient blade assembly. Angle limiter chains are provided to limit the pivoting movement of the resilient blade assembly.

12 Claims, 6 Drawing Sheets

RESILIENT SCRAPING BLADE ATTACHMENT

This application is based on and claims priority benefit of U.S. Provisional Patent Application Ser. No. 60/146,528, filed Jul. 30, 1999, the entire specification of which is incorporated herein by reference.

TECHNICAL FIELD

This invention relates generally to the scraper attachments and, in particular, to resilient scraper attachment assemblies adapted to be readily attachable to prime movers such as tractors, front end loaders, backhoe buckets, or skid steer loaders. The present invention is specifically adapted to remove mud, gravel, and other debris that accumulates on roadways and must be periodically removed.

BACKGROUND OF THE INVENTION

Various debris removal attachments have been used in the past, but their high capital cost and lack of durability and versatility have proven to be a disadvantage in practice. For example, removal of debris with a metal bucket often results in undesirable and uneven wear of the bucket edge. Damage and deformation of a bucket is further accelerated by engagement with curbs, road projections, potholes, or the like. Because of this rapid wear, it is common for metal blades or buckets to be frequently replaced or fixed. In addition, by using such a deformed and rigid bucket, frequently a lot of material remains on the road or pavement due to the deformations in the bucket edge, irregularities in the surface of the pavement, and the general inability of a thick and unyielding bucket edge to wipe a thin coating of wet mud or debris off the pavement. In addition, hard edges of bucket scrapers or metal blades undesirably scrape asphalt off the rocks embedded in the pavement, which allow water to seep therein, which in turn causes premature road damage.

Rotary brooms or brushes have been used to remove material from pavement, however, in practice, material to be removed must be dry in order to be removed with such a broom. In addition, brushes and brooms frequently result in problematic dust creation, which frequently settles back on the roadway in any event.

SUMMARY OF THE INVENTION

Accordingly, it is an object of the present invention to provide a resilient scraping blade attachment of sufficient hardness and durability to address the aforementioned disadvantages of prior art debris removal attachments. This and other advantages of the invention will be set forth in the following description and accompanying drawings.

To achieve the foregoing and other objects, and in accordance with one aspect of the present invention, an improved resilient scraping blade attachment is provided. The resilient scraping blade attachment includes an attachment hook-up assembly adapted to be mounted on a vehicle. The attachment hook-up assembly includes an elongated central support member and a vehicle interface component. In addition, the attachment hook-up assembly includes a pair of diagonal supports that link the central support member to the vehicle interface component. A mounting plate is secured at an end of the central support member.

A resilient blade assembly is attached to the attachment hook-up assembly by means of a bearing bracket and bearing means. The resilient blade assembly includes an elongated blade mounting channel having a pair of resilient blades mounted thereon. The resilient blade assembly includes extension blades that may be mounted at the ends of the blade mounting channel in order to increase the effective width of the resilient blade assembly. The extension blades may be contoured to approximate different surfaces such as a roadside curb.

A hydraulic cylinder is mounted on the attachment hook-up assembly and includes a piston that is mounted on the resilient blade assembly to control and pivot the resilient blade assembly. Angle limiter chains are provided to limit the pivoting movement of the resilient blade assembly.

BRIEF DESCRIPTION OF THE DRAWINGS

The accompanying drawings incorporated in and forming a part of the specification illustrates several aspects of the present invention, and together with the description and claims serves to explain the principles of the invention. In the accompanying drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate corresponding elements throughout the figures.

Figure 1:
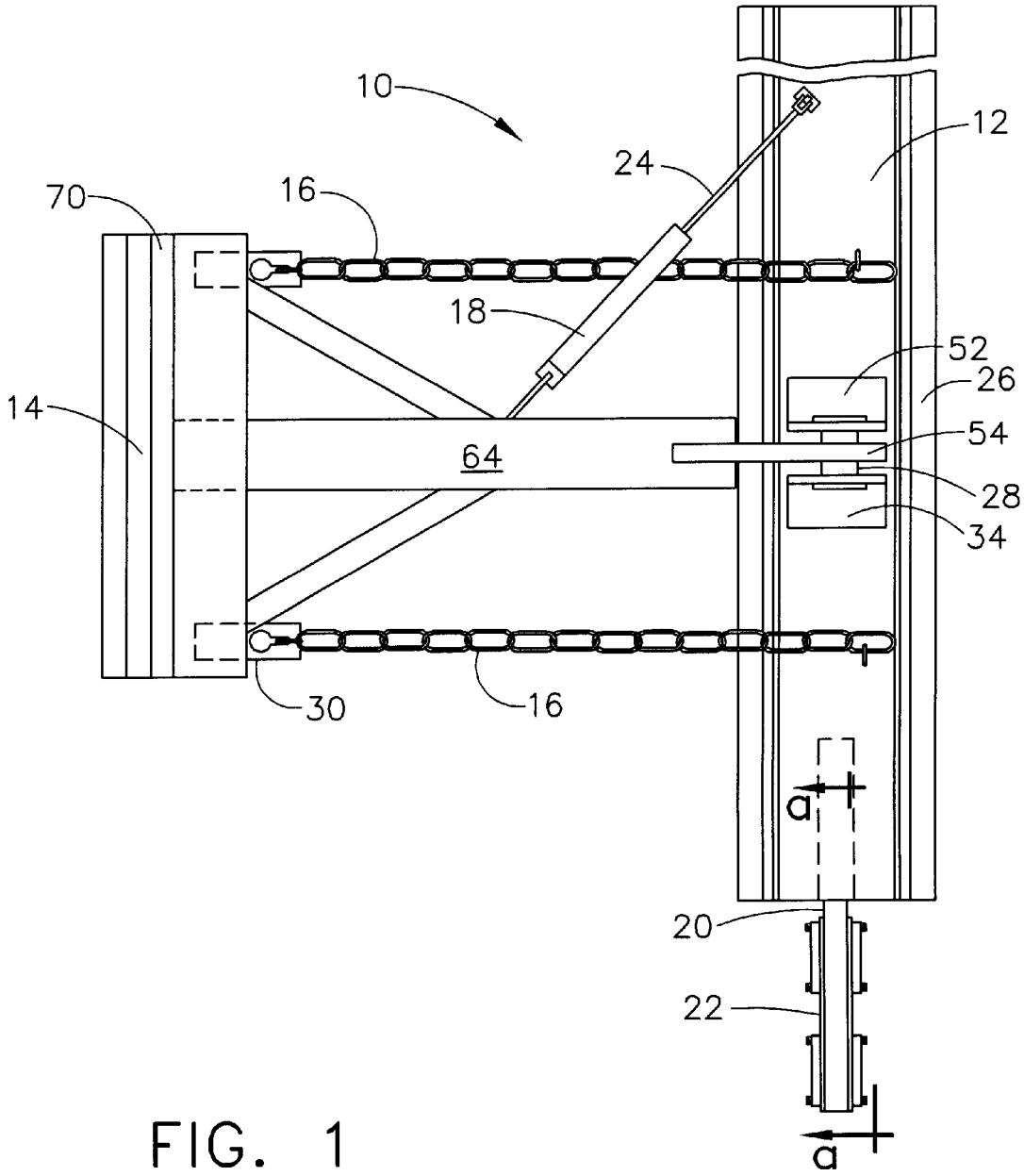
FIG. 1 is a top plan view of the resilient scraping blade attachment of the present invention.

With reference to FIG. 1, the improved resilient scraping blade attachment of the present invention is indicated generally by the reference numeral 10. It should be appreciated that the resilient scraping blade attachment of the present invention is adapted to be mounted on a vehicle, such as a small tractor, skid steer mover, bucket loader, or other similar equipment. As best shown in FIG. 1, the resilient scraping blade attachment 10 includes an attachment hook-up assembly 14. As best shown in FIGS. 1, 3, 8, and 9, the attachment hook-up assembly includes a vehicle interface component 70 adapted to be secured on a vehicle. The attachment hook-up assembly 14 includes a substantially elongated central support member 64 that extends from and is secured on the vehicle interface component 70 of the attachment hook-up assembly 14. One or more diagonal supports or struts 40 are provided to add stability to the attachment hook-up assembly 14 and to link the central support member 64 with the vehicle interface component 70 of the attachment hook-up assembly 14.

Figure 8:
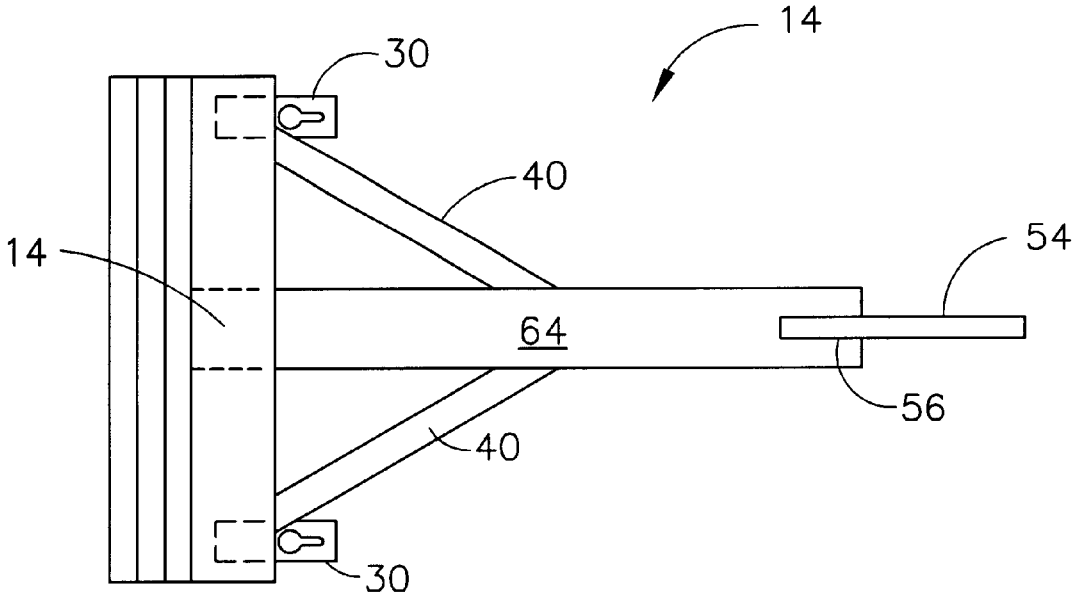
FIG. 8 is a top plan view of the attachment hookup assembly component of the present invention.
Figure 9:
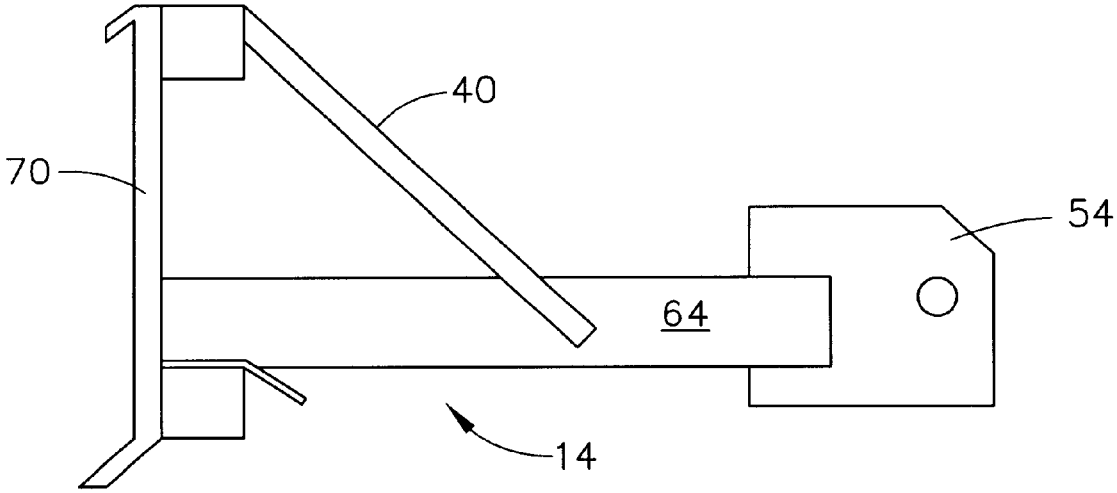
FIG. 9 is a side plan view of the attachment hookup assembly component of the present invention.

As best shown in FIGS. 8 and 9, a preferably substantially planar mounting plate 54 is secured at the far end of central support member 64. Preferably, the mounting plate 54 is secured on the central support member 64 by means of a C-bracket 56.

Figure 3:
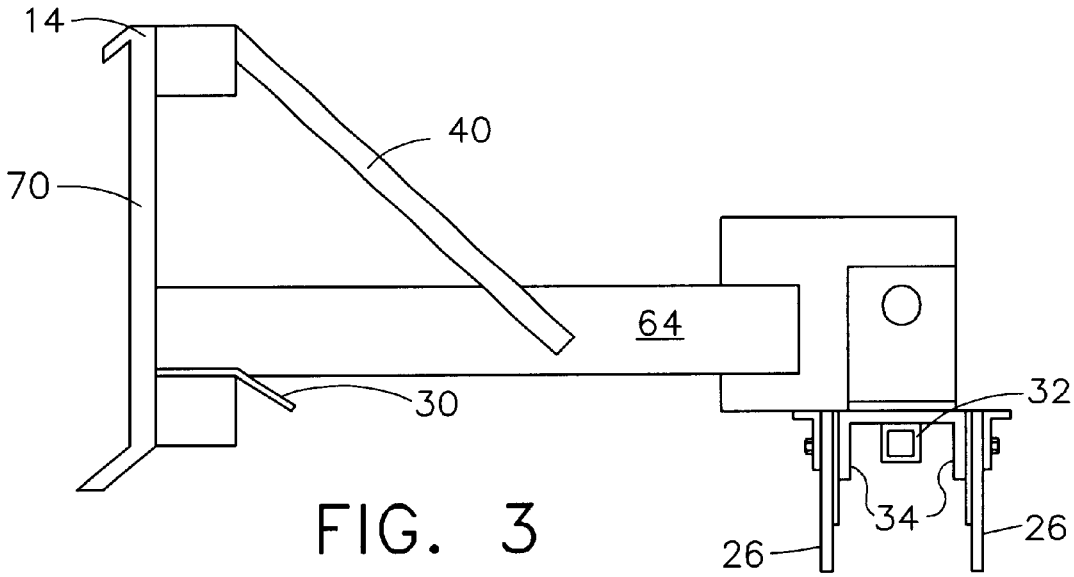
FIG. 3 is a side plan view of the resilient scraping blade attachment of the present invention.

According to an important aspect of the invention, a pivoting resilient blade assembly 12 is mounted on the attachment hook-up assembly 14 (see FIG. 1). The resilient blade assembly 12 includes an elongated blade mounting channel 34. As best shown in FIG. 3, one or more resilient blades 26 are mounted on the elongated blade mounting channel 34. Preferably, the resilient blades 26 are mounted opposite each other on opposing faces of the elongated central support member 64. Preferably, the resilient blades 26 are made of rubber or a durable rubber composite material. More preferably, the resilient blades 26 are made of polyurethane rubber of appropriate durability and hardness. In addition, any other material of sufficient strength and toughness that has abrasive resistance and sufficient resilience to be resistant to chipping or nicking may be used to form the resilient blades 26. Alternatively, the resilient blades 26 may be made of substantially any material exhibiting adequate flexibility and durability.

Figure 7A:
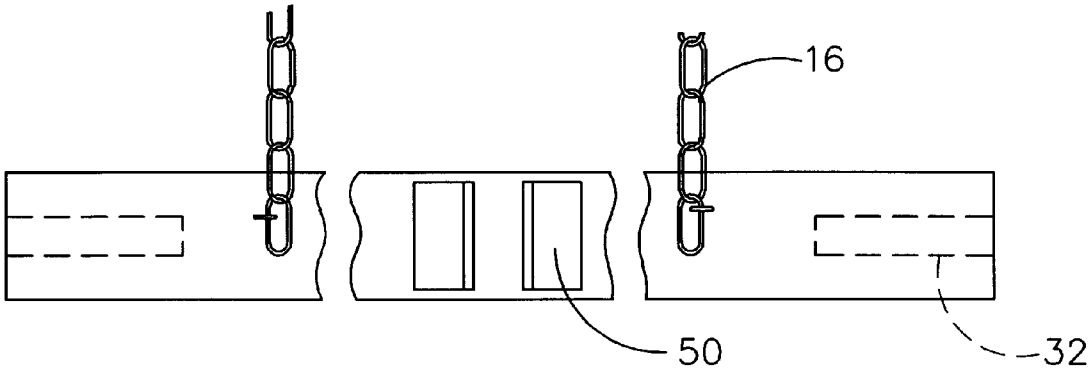
FIG. 7A is a top plan view of the resilient blade assembly component of the present invention.
Figure 7B:
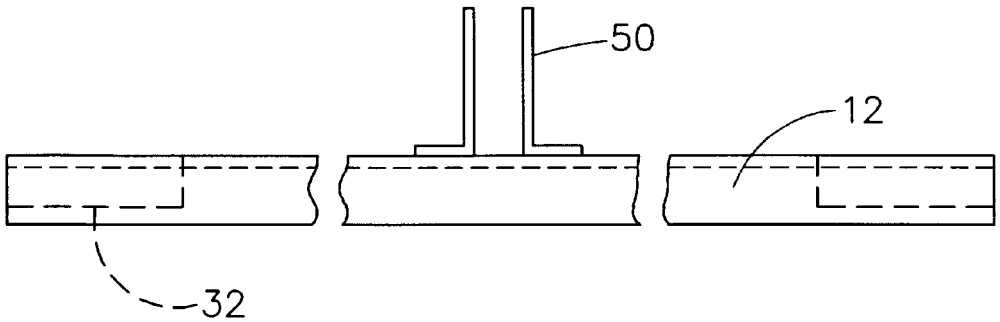
FIG. 7B is a side plan view of the resilient blade assembly component of the present invention.
Figure 7C:
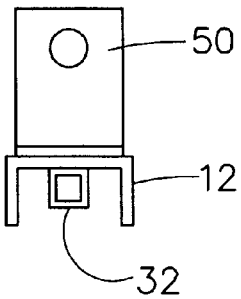
FIG. 7C is an end view of the resilient blade assembly component of the present invention.

As best shown in FIGS. 1 and 3, the resilient blade assembly 12 includes a bearing bracket 50 preferably mounted substantially in the center of the top surface of the central support member 64. (See also FIGS. 7A–C). The bearing bracket 50 receives the mounting plate 54 and is retained in position by bearing means 52, such as a spherical bearing. Bearing 52, bearing bracket 50, and mounting plate 54 combine to create the main pivot region 28 about which the resilient blade assembly 12 may pivot.

Figure 2:
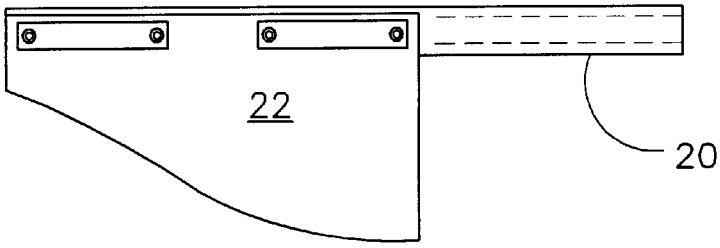
FIG. 2 shows a front plan view taken along the lines a—a of FIG. 1, showing a contoured curb extension arm.

As best shown in FIGS. 1 and 2, the resilient blade assembly 12 includes one or more extension arm mounting tubes 32. The extension arm mounting tubes 32 are adapted to receive extension arms 20 and to retain extension arms 20 and blades 22 in such a manner so as to increase the effective width of the resilient blade assembly 12. Extension blades 22 are particularly of use for wiping or cleaning specific contoured surfaces, such as curbs, driveways, and street intersections.

A hydraulic cylinder as shown in FIG. 1, is preferably mounted on the central support member 64 of the attachment hook-up assembly 14. The piston 24 of the hydraulic cylinder 18 is preferably attached to the top surface of the elongated blade mounting channel 34. By activating the hydraulic cylinder 18 the piston extends, and, as a result, the user may control the angle of the resilient blade assembly 12. Additionally, as shown in FIG. 1, one or more angle limiter chains 16 are provided to control the amount of pivot and rotation of the resilient blade assembly 12. Preferably, the angle limiter chains 16 limit movement to about 10° in either direction from a line perpendicular from the direction of movement of the prime mover vehicle. The angle limiter chains 16 are attached at a first end, preferably on either side of the main pivot region 28. Additionally, a second end of the chains 16 are attached to the vehicle interface component 70 by means of an angled chain bracket 30 (See FIGS. 1 and 3).

Figure 4:
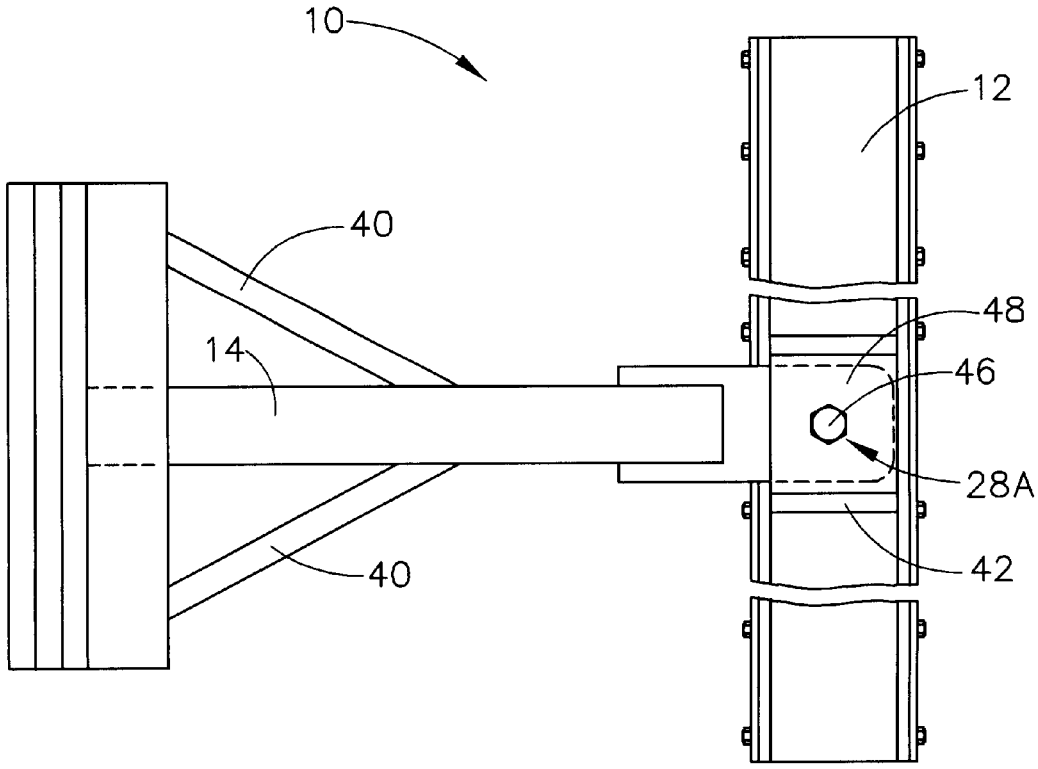
FIG. 4 is a top partially cutaway view of the resilient scraping blade attachment of the present invention showing an alternate pivot pin arrangement.
Figure 5:
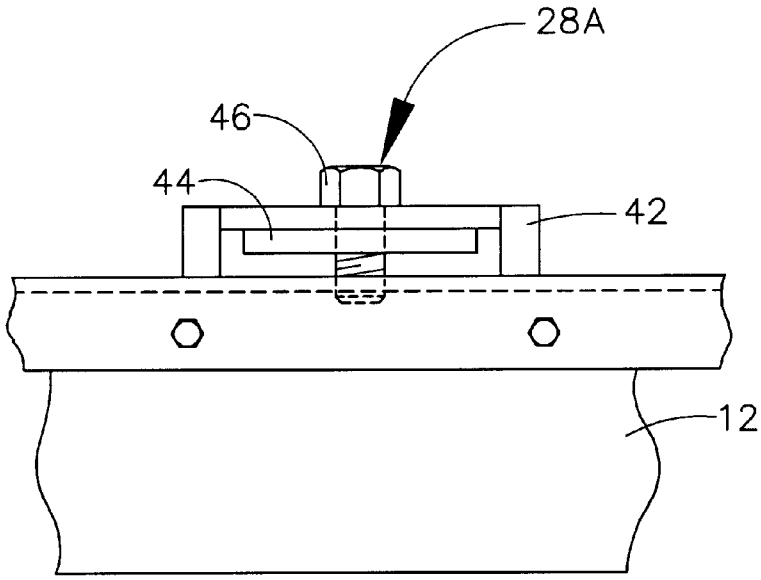
FIG. 5 is a partially cutaway side cross sectional view showing the alternate pivot pin arrangement of FIG. 4.
Figure 6:
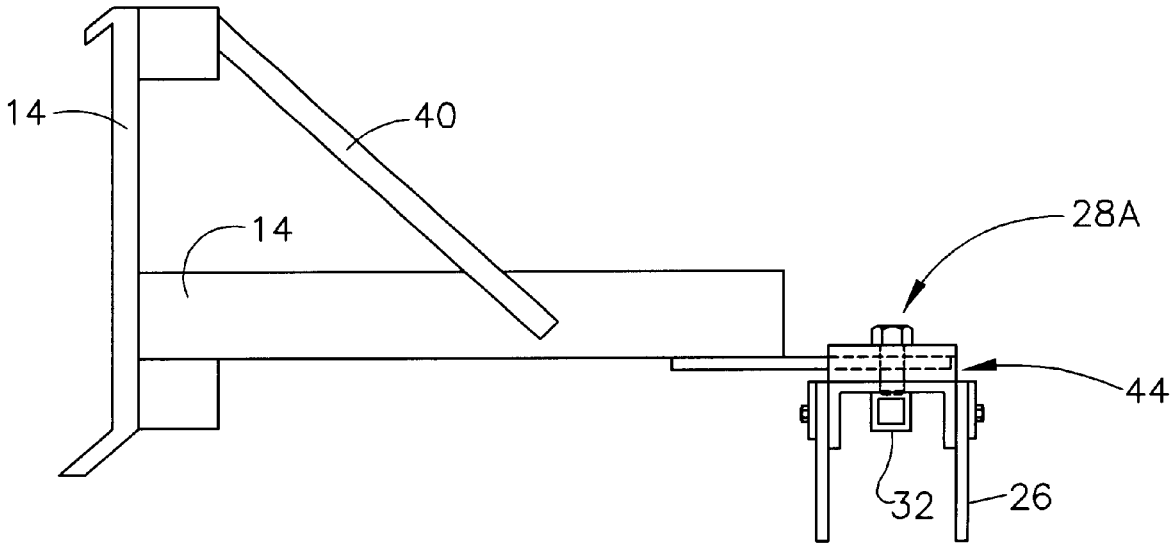
FIG. 6 is a side plan view showing the alternate pivot pin arrangement of FIG. 4.

An alternate main pivot arrangement 28A is shown in FIGS. 4–6. In this pivot arrangement 28A, a pivot plate 48 is provided in place of the mounting plate 54. The pivot plate is attached substantially horizontally, preferably with a C-bracket 56. The pivot plate is received within pivot chamber 44 and held in place by pivot pin 46. (See FIG. 5). Pivot limiting walls 42 (see FIG. 4) are provided to limit the amount of pivot of resilient blade assembly 12. As shown in FIG. 5, in this embodiment, the pivot chamber 44 allows for up and down movement of the resilient blade assembly as well.

Figure 11:
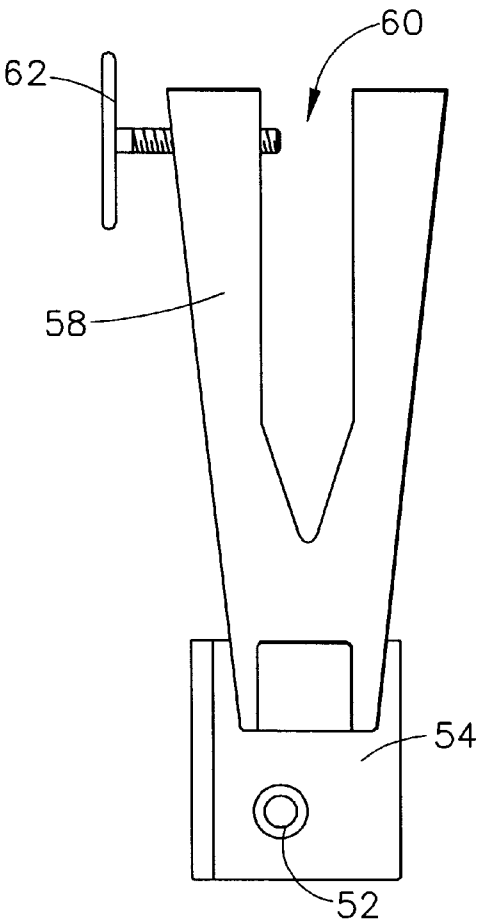
FIG. 11 is a side view of an alternate embodiment of the present invention configured for attachment to a bucket loader.
Figure 10:
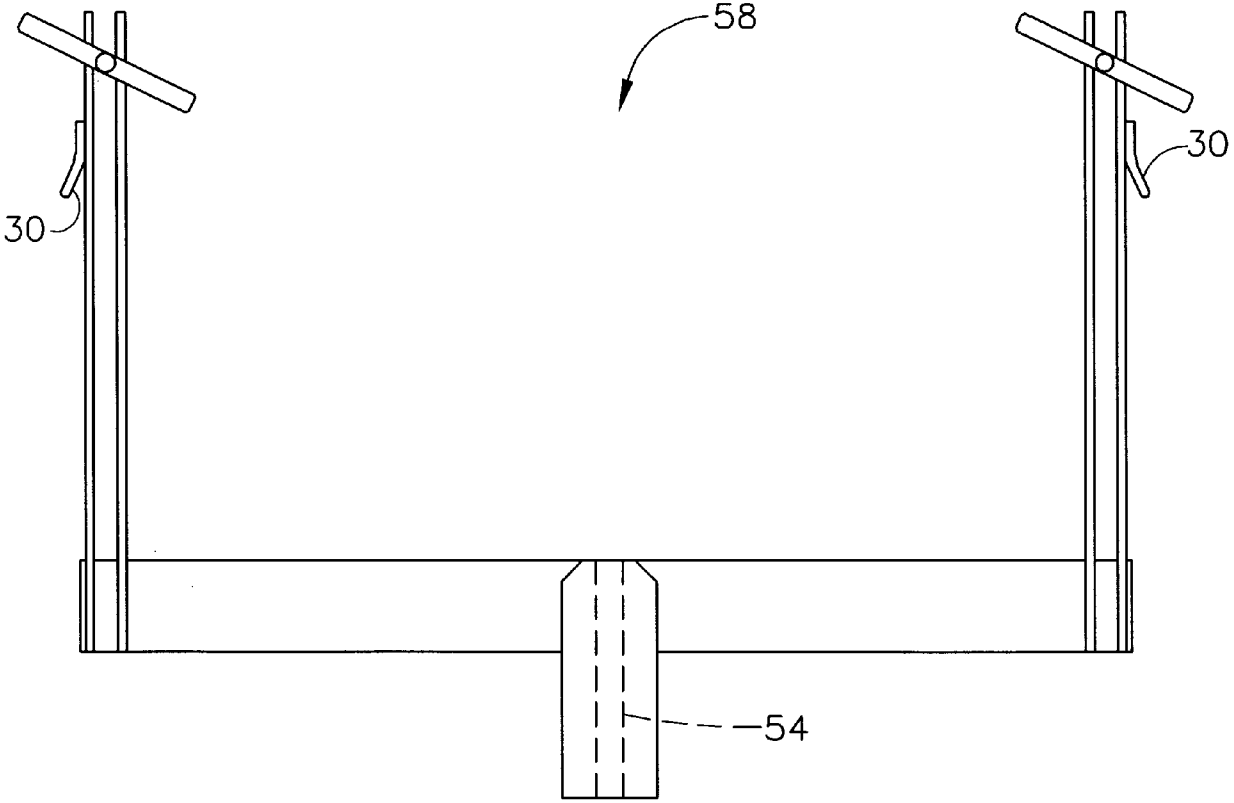
FIG. 10 is a top plan view of an alternate embodiment of the present invention configured for attachment to a bucket loader.

As shown in FIGS. 10 and 11, an alternate attachment hook-up assembly for a bucket loader 58 is shown. As shown in FIG. 11, a bucket attachment hook-up assembly recess 60 is adapted to receive a forward portion of a bucket of a bucket loader and can be secured in place by securing means 62 such as a clamp, bolt assembly, or any conventional securing mechanism. Mounting plate 54 operates in much the same manner as shown and described in relation to the attachment hook-up assembly 14 and may be held in place with spherical bearing 52 on a resilient blade assembly 12.

After the attachment or hook-up of the assembly is accomplished onto a metal bucket or a skid steer loader, the resilient blade assembly 12 is selectively lowered onto the paved surface to be cleaned. The prime mover may be driven forward or backward as desired to scrape or wipe the pavement clean. Advantageously, the blade assembly can maintain good contact with the pavement because of the flexibility of the blades 26. The blade 26 may also pivot in all three rotational degrees of freedom due to the provision of the main center pivot 28, 28A. Accordingly, a more effective seal against the pavement and closer contact is achieved even when the pavement surface has irregular slopes or other surface irregularities, projections, or discontinuities. It should be appreciated that the blade assembly may also be rotated to an angle relative to direction of movement during use to push the material to be removed to one end or the other of the assembly.

The foregoing description of a preferred embodiment of the invention has been presented for the purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A hydraulically operated resilient scraping blade attachment adapted to be mounted on a vehicle comprising:

a) an attachment hookup assembly adapted to be mounted on said vehicle, said attachment hookup assembly comprising an elongated central support member, said attachment hookup assembly further comprising one or more diagonal supports attached to said central support member, said attachment hookup assembly further comprising a mounting plate secured at an end of said central support member;

b) a resilient blade assembly, said resilient blade assembly comprising an elongated blade mounting channel, said elongated blade mounting channel comprising one or more resilient blades mounted thereon, said resilient blade assembly further comprising one or more extension arm mounting tubes mounted on said elongated blade mounting channel, said extension arm mounting tubes adapted to receive one or more extension blades in such a manner to increase the effective width of said resilient blade assembly, said resilient blade assembly further comprising a bearing bracket mounted thereon, said bearing bracket adapted to receive and retain said mounting plate by bearing means;

c) angle limiter means, said angle limiter means comprising one or more hydraulic cylinders mounted on said attachment hookup assembly, each of said one or more hydraulic cylinders comprising a piston mounted on said resilient blade assembly, said angle limiter means further comprising one or more angle limiter chains adapted to limit the pivoting movement of said resilient blade assembly, each of said one or more angle limiter chains being secured at a first end to said resilient blade assembly and at a second end to said an attachment hookup assembly.

2. The scraping blade attachment of claim 1 wherein said attachment hookup assembly further comprises a vehicle interface component, said elongated central support member being secured to and extending from said vehicle interface component, said one or more diagonal supports linking said central support member with said vehicle interface component.

3. The scraping blade attachment of claim 1 wherein said mounting plate is secured on said elongated central support member by a C-bracket.

4. The scraping blade attachment of claim 1 wherein said one or more resilient blades comprise two resilient blades, each of said resilient blades being mounted opposite each other on opposing faces of said elongated central support member.

5. The scraping blade attachment of claim 4 wherein said resilient blades are comprised of rubber.

6. The scraping blade attachment of claim 4 wherein said resilient blades are comprised of a durable rubber composite material.

7. The scraping blade attachment of claim 3 wherein said bearing bracket is mounted substantially in the center of the top surface of said elongated central support member.

8. The scraping blade attachment of claim 7 wherein said mounting plate is retained in position in said bearing bracket by a spherical bearing.

9. The scraping blade attachment of claim 1 further comprising extension arms, said extension arms adapted to be received within said extension arm mounting tubes.

10. The scraping blade attachment of claim 9 wherein said extension arms each comprise contoured extension blades.

11. A hydraulically operated resilient scraping blade attachment adapted to be mounted on a vehicle comprising:

a) an attachment hookup assembly adapted to be mounted on said vehicle, said attachment hookup assembly comprising an elongated central support member, said attachment hookup assembly further comprising one or more diagonal supports attached to said central support member, said attachment hookup assembly further comprising a substantially horizontally disposed pivot plate secured at an end of said central support member;

b) a resilient blade assembly, said resilient blade assembly comprising an elongated blade mounting channel, said elongated blade mounting channel comprising one or more resilient blades mounted thereon, said resilient blade assembly further comprising one or more extension arm mounting tubes mounted on said elongated blade mounting channel, said extension arm mounting tubes adapted to receive one or more extension blades in such a manner to increase the effective width of said resilient blade assembly, said resilient blade assembly further comprising a pivot chamber, said pivot chamber adapted to receive said pivot plate, said pivot plate being held in place at least partially within said pivot chamber by a pivot pin, said pivot chamber comprising pivot limiting walls adapted to limit the amount of pivot of said pivot plate and said resilient blade assembly;

c) angle limiter means, said angle limiter means comprising one or more hydraulic cylinders mounted on said attachment hookup assembly, each of said one or more hydraulic cylinders comprising a piston mounted on said resilient blade assembly, said angle limiter means further comprising one or more angle limiter chains adapted to limit the pivoting movement of said resilient blade assembly, each of said one or more angle limiter chains being secured at a first end to said resilient blade assembly and at a second end to said an attachment hookup assembly.

12. A hydraulically operated resilient scraping blade attachment adapted to be mounted on a vehicle comprising:

a) an attachment hookup assembly adapted to be mounted on a bucket loader, said attachment hookup assembly comprising first and second arms, each of said arms comprising a hookup assembly recess adapted to receive a forward portion of a bucket loader, said hookup assembly recesses further comprising securing means for securing said arms to said bucket, said hookup assembly further comprising a transverse support member with said first and second arms extending therefrom, said transverse support member further comprising a mounting plate secured at the mid-point of said transverse support member;

b) a resilient blade assembly, said resilient blade assembly comprising an elongated blade mounting channel, said elongated blade mounting channel comprising one or more resilient blades mounted thereon, said resilient blade assembly further comprising one or more extension arm mounting tubes mounted on said elongated blade mounting channel, said extension arm mounting tubes adapted to receive one or more extension blades in such a manner to increase the effective width of said resilient blade assembly, said resilient blade assembly further comprising a bearing bracket mounted thereon, said bearing bracket adapted to receive and retain said mounting plate by bearing means;

c) angle limiter means, said angle limiter means comprising one or more hydraulic cylinders mounted on said attachment hookup assembly, each of said one or more hydraulic cylinders comprising a piston mounted on said resilient blade assembly, said angle limiter means further comprising one or more angle limiter chains adapted to limit the pivoting movement of said resilient blade assembly, each of said one or more angle limiter chains being secured at a first end to said resilient blade assembly and at a second end to said an attachment hookup assembly.

* * * * *